US008464475B2

(12) United States Patent
McDow, Jr. et al.

(10) Patent No.: US 8,464,475 B2
(45) Date of Patent: Jun. 18, 2013

(54) PIPE FLASHING APPARATUS AND METHOD

(71) Applicant: Golden Rule Fasteners, Inc., Tallassee, AL (US)

(72) Inventors: William Archie McDow, Jr., Tallassee, AL (US); David Campbell McDow, Montgomery, AL (US)

(73) Assignee: Golden Rule Fasteners, Inc., Tallassee, AL (US)

( * ) Notice: Subject to any disclaimer, the term of this patent is extended or adjusted under 35 U.S.C. 154(b) by 0 days.

(21) Appl. No.: 13/723,588

(22) Filed: Dec. 21, 2012

(65) Prior Publication Data

US 2013/0113204 A1 May 9, 2013

Related U.S. Application Data

(63) Continuation of application No. 13/403,444, filed on Feb. 23, 2012, which is a continuation of application No. 12/604,933, filed on Oct. 23, 2009, now Pat. No. 8,141,303.

(51) Int. Cl.

| | |
|---|---|
| ***E04D 1/36*** | (2006.01) |
| ***E04D 3/38*** | (2006.01) |
| ***E04D 13/14*** | (2006.01) |
| ***E04B 1/00*** | (2006.01) |
| ***E04B 7/00*** | (2006.01) |

(52) U.S. Cl.

USPC ..... 52/58; 52/60; 52/63; 52/98; 52/198; 52/219

(58) Field of Classification Search

USPC ..... 52/58, 60, 63, 98, 198, 219; 285/42, 285/43, 44, 3, 4, 177

See application file for complete search history.

(56) References Cited

U.S. PATENT DOCUMENTS

| | | | | | |
|---|---|---|---|---|---|
| 4,903,997 | A * | 2/1990 | Kifer | 285/43 |
| 5,036,636 | A * | 8/1991 | Hasty | 52/100 |
| 5,176,408 | A * | 1/1993 | Pedersen | 285/42 |
| 5,226,263 | A * | 7/1993 | Merrin et al. | 52/58 |
| 5,588,267 | A * | 12/1996 | Rodriguez et al. | 52/219 |
| 6,185,885 | B1 * | 2/2001 | Thaler | 52/219 |
| 2007/0101664 | A1 * | 5/2007 | Hoy et al. | 52/198 |

OTHER PUBLICATIONS

Multi-Flash Master Flash®—"Two Flashings in One"—http://www.aztecwasher.com.

* cited by examiner

*Primary Examiner* — Mark Wendell
(74) *Attorney, Agent, or Firm* — Husch Blackwell LLP

(57) ABSTRACT

A roof flashing that can be installed around a pipe, instead of over the pipe, is provided. The roof flashing can include a collar, a base, a foot, and a longitudinal opening. The collar can have a conical shape, and the base can have a top edge and a bottom edge such that the top edge of the base is coupled to a bottom edge of the collar. The foot can be coupled to the bottom edge of the base and extend outwardly from the bottom edge of the base. The longitudinal opening can extend from an apex of the collar to an edge of the foot and can include first, second, and third sections. A width of the longitudinal opening can increase when first and second edges of the opening are pulled away from each other.

9 Claims, 4 Drawing Sheets

PIPE FLASHING APPARATUS AND METHOD

CROSS-REFERENCE TO RELATED APPLICATIONS

This application is a Continuation of and claims the benefit of the filing date of U.S. application Ser. No. 13/403,444 filed Feb. 23, 2012, which is a Continuation of and claims the benefit of the filing date of U.S. application Ser. No. 12/604,933 filed Oct. 23, 2009, now U.S. Pat. No. 8,141,303 issued Mar. 27, 2012.

FIELD OF THE INVENTION

The present disclosure generally relates to the field of flashing systems for pipes that extend through a shingle roof or other similar type of roof.

BACKGROUND

A roof flashing is often placed around discontinuities or objects which extend through or from the roof of a building in order to deflect water away from seams or joints. For example, a roof flashing is often used to prevent rain water from leaking about a pipe protruding from the roof. Modern roof flashing may be metal, rubber or other waterproof synthetic materials that are shaped to meet a specific need.

A typical roof flashing for a pipe has an extension that fits snuggly about the pipe and where the extension has a downward taper away from the pipe and a base that is approximately perpendicular to the pipe, for attaching the flashing to roof decking. Caulking is sometimes used around seams formed where the pipe flashing material contacts the pipe or decking to ensure water does not leak through the roof of the structure and into the building protected by the roof.

There are roof flashings for metal roofing. The roof flashings for metal roofs have extensions through which pipes or other objects can extend, as described hereinabove. In addition, the roof flashings have a small flange-like base that extends from bottom of the extension for attaching the roof flashing to the metal roof. There are some metal roof flashings that have an opening that extends the entire length of the extension for wrapping the roof flashing around the pipe or the object before it is attached, via the based, to the metal roof. Caulking can then be used around the base to where it attaches to the metal roof and around the opening through which the pipe or object extends in order to mitigate or prevent leakage. One such roof flashing is described in U.S. Pat. No. 5,176,408.

BRIEF DESCRIPTION OF THE DRAWINGS

The disclosure can be better understood with reference to the following drawings. The elements of the drawings are not necessarily to scale relative to each other, emphasis instead being placed upon clearly illustrating the principles of the invention. Furthermore, like reference numerals designate corresponding parts throughout the several views.

DETAILED DESCRIPTION

The present disclosure generally pertains to a roof flashing that provides a weather-proof seal for keeping water and other material from leaking into a building. The roof flashing of the present disclosure is installable around a pipe, for example, as opposed to being installed by sliding the flashing over the top of the pipe. In addition, the roof flashing of the present disclosure is for use on shingle roofing or shingle-like roofing in that it integrates with the shingles on the roof in order to mitigate or prevent moisture from leaking through the shingle roofing, which is described further herein.

Figure 1:
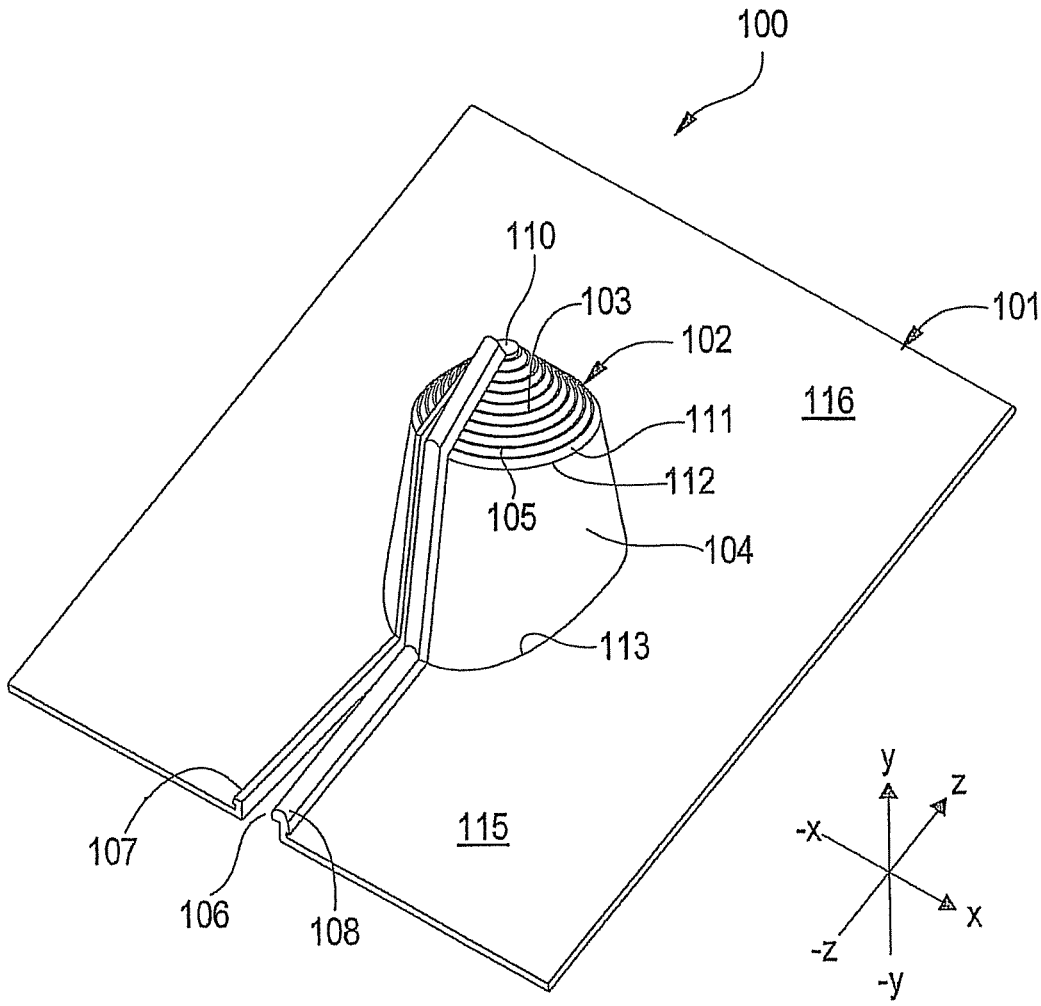
FIG. 1 depicts an exemplary embodiment of a roof flashing for the present disclosure.

One embodiment of a roof flashing 100 for shingle roofing is depicted in FIG. 1. The roof flashing 100 is comprised of a collar 102, a base 104 and a foot 101. The collar 102 has a cone shape with an apex 110 extending upward, the z-direction; and a bottom edge 111. The bottom edge 111 of the collar 102 is coupled to the base 104 about a top edge 112 of the base. The collar 102 and the base 104 are made of an elastomeric material in order for a pipe attachment edge 103 to stretch about a pipe (not shown) when the flashing 100 is installed. Note that the collar 102 comprises a plurality of pipe attachment edges 103.

The attachment edge 103 is formed, as will be shown, when material is removed from the collar 102. A bottom edge 113 of the base 104, located in the negative z-direction, from the top edge 112 and has a slightly larger diameter then the top edge 112.

Note that the collar 102, the base 104 and the foot 101 are coupled together utilizing attachment methods well-known by those skilled in fabricating devices with elastomeric materials. In other embodiments, the flashing 100 is made of other materials and other fabrication methods are possible. The flashing 100 may be fabricated in a single molding operation or may be made by combining parts together using attachment methods that provide water-proof joints.

The foot 101 is substantially rectangular and extends outwardly from the bottom edge 113 of the base 104. The foot 101 is sufficiently extended in the −z direction so that a front portion 115 of the foot 101 can be layered on top of one or more shingles (not shown) of a shingle roof. In addition, the foot 101 is sufficiently extended in the +z direction so that a back portion 116 of the foot 101 so that one or more shingles (not shown) can be layered on top of the back portion 116 of the foot 101. Integrating the foot 101 with the shingles by layering the foot 101 with the shingles mitigates or prevents moisture from penetrating the shingle roofing where the roof flashing 101 is installed. Such layering of the roof flashing 100 with the shingles is described further with reference to FIG. 6.

Note that in one embodiment the foot 101 has embedded reinforcement material, such as a thin sheet of metal, molded within the elastomeric material forming the foot 101. The foot 101 and the base 104 are coupled together at different angles in order to meet the needs of roofs with different pitches (roof slope). In one embodiment the base 104 has sufficient height and flexibility for installation on shingle roofs having a range of pitches. In this regard, the thickness and flexibility of the foot 101 is such that it acts as a shingle.

Figure 4:
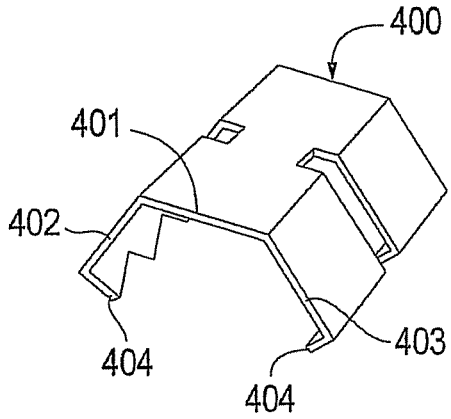
FIG. 4 depicts a clip that is used for holding the members of the closure together.

A longitudinal opening 106 extends from the apex 110 of the collar 102 to an edge of the foot 101. The longitudinal opening 106 is defined by a first edge 108 and a second edge 107 of the flashing 100 as seen in FIG. 1. When the first edge 108 and second edge 107 are pulled away from each other in the x-direction the width of the opening 106 increases. When the opening 106 extends to a distance greater than a corresponding pipe diameter, the flashing 100 is prepared for placement about the pipe. After the top portion of the collar 102 is placed about a pipe, the first edge 108 and the second edge 107 are brought together to provide a longitudinal seal. When the first edge 108 and second edge 107 are in contact one or more fasteners, such as clip 400 as depicted in FIG. 4, secure and press the edges defining the longitudinal opening together.

The longitudinal opening 106 allows for the installation of the roof flashing 100 about a pipe (not shown) over which a flashing could not be placed. As an example, the pipe may be an electrical pipe that has wires that extend therefrom. In such an example, it is not possible to slide a flashing over the top of the electrical pipe. Instead, the roof flashing 100 can be installed around the pipe via the longitudinal opening 106 and thereafter secured as described hereinabove. As another example, the pipe may have a hood or weatherhead that prevents installation of a flashing over the top of the pipe. Again, the roof flashing 100 can be installed around the pipe via the longitudinal opening 106 and thereafter secured.

Figure 2:
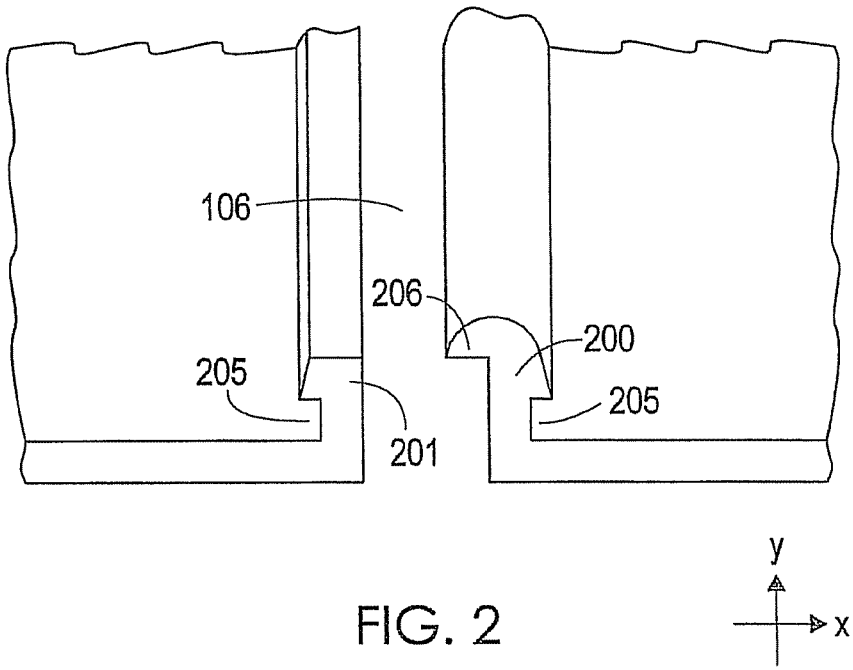
FIG. 2 depicts details of a closure of the roof flashing of FIG. 1.
Figure 3:
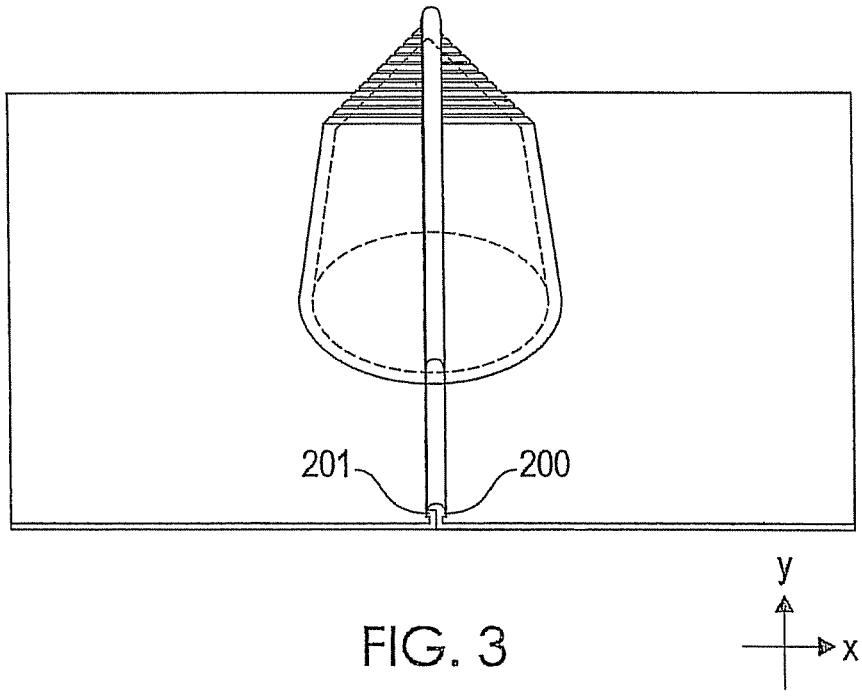
FIG. 3 depicts the closure of the roof flashing system of FIG. 1 when closure members are connected.
Figure 5:
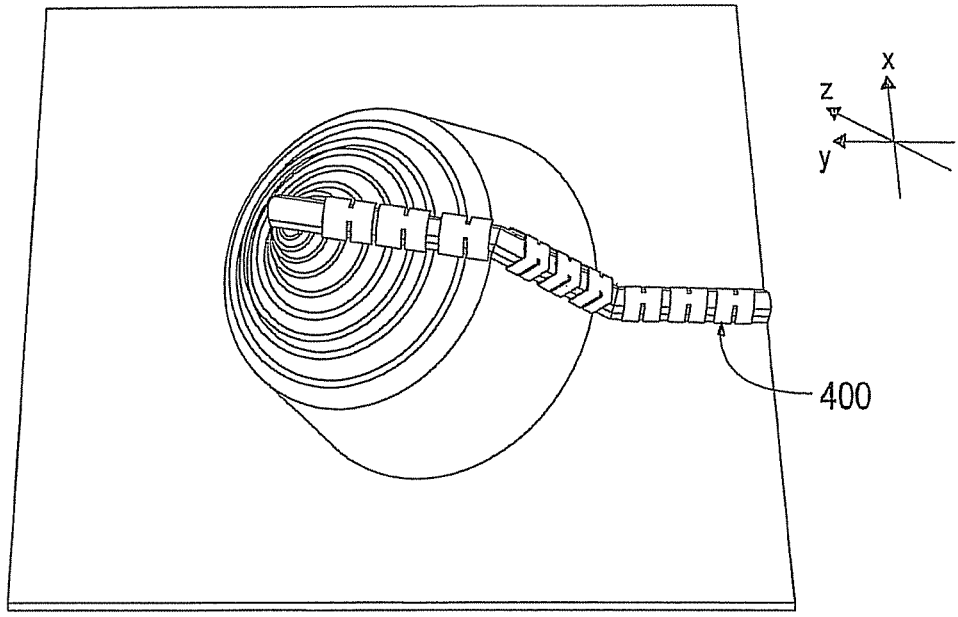
FIG. 5 depicts several clips coupled to the members of the closure.

An embodiment for providing a longitudinal seal is depicted FIG. 2. A first edge member 201 has a rectangular cross section and a clip groove 205 formed in part by a portion of the top surface of the foot 101. A second edge member 200 is rounded on the top of the outside edge and has a clip groove 205 and a flap 206 where the flap 206 is sized to fit against and over the top of the first edge member 201. When first edge member 201 is engaged with second edge member 200 as shown in FIG. 3, the clip grooves 205 are positioned to receive clips 400 (shown in FIG. 4). The edges 404 of the clip 400 are placed in clip grooves 205 and the clip 400 is crimped, i.e., squeezed together using a crimping tool or a pair of pliers. In order to provide a weather-proof longitudinal seal multiple clips 400 are crimped about the edge members as best seen in FIG. 5. The clips are placed from an edge of the foot 101 to a location near the apex 110 of the collar 102.

In order to securely attach the collar 102 about a pipe of a specific diameter; such as, for example, a 1.5 inch pipe, it is necessary to remove material from the collar as shown in FIG. 1. The pipe attachment edges 103 have increasing diameters when going downward, the negative z-direction, from the apex 110 of the collar 102. In one embodiment, the pipe attachment edges 103 are labeled with markings on the collar 102 so an installer knows what material to remove for a specific pipe diameter. As an example, for a 1.5 inch pipe, an installer removes, by tearing and/or cutting, material away from the center portion of the collar 102 along the tear groove labeled 1.5 inches. The opening defined by the top edge of the collar 102 when the material is removed is somewhat smaller than the diameter of the corresponding pipe in order that the collar edge stretch circumferentially around the pipe thereby providing a snug fit and a weather-proof seal when the edges of the collar 102 engage the surface of the pipe. In one embodiment, the collar 102 has eight annular tear grooves 103 so that the flashing 100 is configured to provide a weather-proof seal for pipes of many different diameters. Notably, each pipe attachment edge 103 can be used for a number of different pipe sizes. FIG. 4 depicts an embodiment of a clip 400 that is used to hold the edges defining the longitudinal opening 106 together. The clip 400 has bottom edges 404 that are turned inward. Extending downward from a top member 401 of the clip 400 are a left arm 402 and a right arm 403, as shown in FIG. 4. Each of the arms has an inwardly turned tab that extends the length of the clip 400 and defines the bottom edges 404. When the clip 400 is placed over the longitudinal members 200, 201, as shown in FIG. 2, the clip 400 is crimped so that the edges 404 press against and lock to the inner surfaces of the clip grooves 205. The clip 400 is made of metal or other material that is malleable and is able to go through several open and close cycles without losing any gripping ability.

Figure 6:
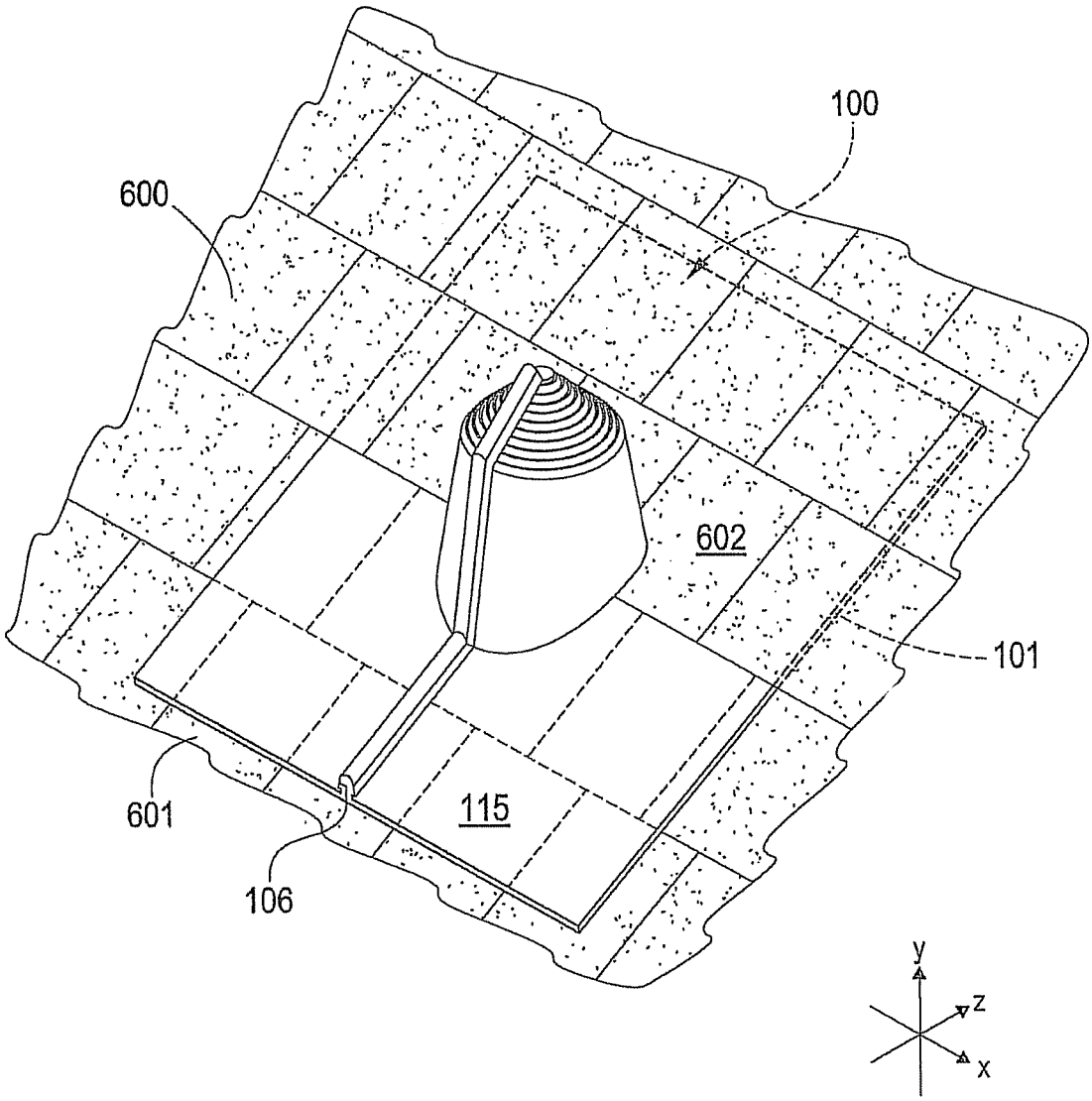
FIG. 6 depicts the roof flashing attached to a roof.

FIG. 6 depicts the roof flashing 100 when installed on a roof 600. A front portion 115 that comprises the longitudinal opening of the foot 101 is placed over one or more roofing shingles 601. In addition, one or more shingles 602 are placed atop of a back portion 116 (FIG. 1) of the foot 101.

Note that when installing the roof flashing, the longitudinal opening 106 is in a separated position, like shown in FIG. 1. When separated, it wraps around a pipe or object that extends from the roof decking. The longitudinal opening 106 is then coupled together such that the front portion 115 of the foot 101 is exposed and on top of one or more of the shingles 601. Once the roof flashing 101 is installed around the pipe or object, the shingles 602 are placed on top of the back portion 116 of the foot 101. Layering the foot 101 by placing it on top of shingles 601 and beneath the shingles 602 mitigates or prevents leakage around the roof flashing 101.

The foot 101 is attached to the roof decking using roofing nails (not shown) or other roofing fasteners (not shown). After the flashing 100 is fastened in place, the shingles 602 are placed on top of the back portion 116 of the foot 101 so that water will drain around and over the flashing 100.

The foot 101 of the roof flashing 100 may have thin sheets of metal (not shown) embedded within the elastomeric material forming the foot 101 in order to keep roof fasteners from damaging the foot 101. In addition, the thin sheetsof metal makes the foot 101 more rigid to minimize or prevent lifting of the foot 101 by wind, which may cause water infiltration.

It should be emphasized that the above-described embodiments of the present disclosure are merely examples of implementations, set forth for a clear understanding of the principles of the disclosure. Many variations and modifications may be made to the above-described embodiments of the disclosure without departing substantially from the spirit and principles of the invention. All such modifications and variations are intended to be included herein within the scope of this disclosure and the present invention and protected by the following claims.

Now, therefore, the following is claimed:

1. A roof flashing comprising:

a collar, the collar having a conical shape with an apex and a bottom edge;

a base, the base having a top edge and a bottom edge, the top edge of the base coupled to the bottom edge of the collar;

a foot coupled to the bottom edge of the base and extending outwardly from the bottom edge of the base; and a longitudinal opening extending from the apex of the collar to an edge of the foot, wherein the longitudinal opening includes first, second, and third sections, wherein the first section of the longitudinal opening traverses a portion of the collar from the apex to the bottom edge of the collar at a point where the bottom edge of the collar is coupled to the top edge of the base, wherein the second section of the longitudinal opening traverses a portion of the base from the top edge of the base to the bottom edge of the base at a point where the bottom edge of the base is coupled to the foot, wherein the third section of the longitudinal opening traverses a portion of the foot from the point where the bottom edge of the base is coupled to the foot to the edge of the foot, and wherein the longitudinal opening has first and second edges such that when the first and second edges are pulled away from each other a width of the longitudinal opening increases to enable the roof flashing to be installable around a pipe which is not capable of receiving the roof flashing over a top thereof.

2. The roof flashing of claim 1 wherein at least one of the collar, the base, and the foot is made of elastomeric material.

3. The roof flashing of claim 2 wherein the at least one of the collar, the base, and the foot includes a reinforcement material for reinforcing the elastomeric material.

4. The roof flashing of claim 3 wherein the reinforcement material is embedded in the elastomeric material.

5. The roof flashing of claim 1 wherein at least one of the collar, the base, and the foot includes a reinforcement material.

6. The roof flashing of claim 5 wherein the reinforcement material is embedded in the at least one of the collar, the base, and the foot.

7. The roof flashing of claim 1 wherein the foot is substantially rectangular.

8. A roof flashing comprising:

a collar, the collar having a conical shape with an apex and a bottom edge;

a base, the base having a top edge and a bottom edge, the top edge of the base coupled to the bottom edge of the collar;

a foot coupled to the bottom edge of the base and extending outwardly from the bottom edge of the base; and a longitudinal opening extending from the apex of the collar to an edge of the foot, wherein the longitudinal opening includes first, second, and third sections, wherein the first section of the longitudinal opening traverses a portion of the collar from the apex to the bottom edge of the collar at a point where the bottom edge of the collar is coupled to the top edge of the base, wherein the second section of the longitudinal opening traverses a portion of the base from the top edge of the base to the bottom edge of the base at a point where the bottom edge of the base is coupled to the foot, wherein the third section of the longitudinal opening traverses a portion of the foot from the point where the bottom edge of the base is coupled to the foot to the edge of the foot, wherein the longitudinal opening has first and second edges such that when the first and second edges are pulled away from each other a width of the longitudinal opening increases to enable the roof flashing to be installable around a pipe which is not capable of receiving the roof flashing over a top thereof, and wherein the foot is associated with a reinforcement material.

9. The roof flashing of claim 8 wherein the reinforcement material is embedded in the foot.

* * * * *